US008967510B2

(12) United States Patent
Chen et al.

(10) Patent No.: US 8,967,510 B2
(45) Date of Patent: Mar. 3, 2015

(54) SAFETY SHREDDER

(71) Applicants: Kevin Chen, Palos Verdes, CA (US); Chung Shih Tsai, Hawthorne, CA (US); Hsin-Hsiung Chen, Shanghai (CN)

(72) Inventors: Kevin Chen, Palos Verdes, CA (US); Chung Shih Tsai, Hawthorne, CA (US); Hsin-Hsiung Chen, Shanghai (CN)

(73) Assignee: Aurora Office Equipment Co., Ltd., Shanghai (CN)

( * ) Notice: Subject to any disclaimer, the term of this patent is extended or adjusted under 35 U.S.C. 154(b) by 314 days.

(21) Appl. No.: 13/629,360

(22) Filed: Sep. 27, 2012

(65) Prior Publication Data

US 2014/0084093 A1 Mar. 27, 2014

(51) Int. Cl.
*B02C 23/00* (2006.01)

(52) U.S. Cl.
USPC ..... 241/37.5; 241/100

(58) Field of Classification Search
USPC ..... 241/36, 37.5, 100, 222, 224, 236
See application file for complete search history.

(56) References Cited

U.S. PATENT DOCUMENTS

| | | | | |
|---|---|---|---|---|
| 4,411,391 | A | 10/1983 | Crane | |
| 4,817,877 | A | 4/1989 | Itoh et al. | |
| 4,842,205 | A | 6/1989 | Araki et al. | |
| 5,044,270 | A | 9/1991 | Schwelling | |
| 5,969,310 | A | 10/1999 | Schwelling | |
| 6,065,696 | A | 5/2000 | Tsai | |
| 6,116,528 | A * | 9/2000 | Schwelling | 241/36 |
| 6,676,050 | B2 * | 1/2004 | Chang | 241/37.5 |
| 6,682,006 | B2 | 1/2004 | Lee | |
| 6,964,386 | B2 * | 11/2005 | Ho | 241/236 |
| 7,083,131 | B2 | 8/2006 | Ting | |
| 7,414,212 | B2 | 8/2008 | Huang | |
| 2006/0054752 | A1 | 3/2006 | Matlin | |
| 2006/0219827 | A1 | 10/2006 | Matlin et al. | |
| 2007/0012808 | A1 | 1/2007 | Kao | |
| 2007/0034725 | A1 * | 2/2007 | Duh | 241/236 |
| 2007/0246581 | A1 | 10/2007 | Matlin et al. | |
| 2008/0006728 | A1 | 1/2008 | Zhang | |
| 2008/0105772 | A2 | 5/2008 | Matlin | |
| 2008/0156912 | A1 | 7/2008 | Huang | |
| 2008/0164351 | A1 | 7/2008 | Wang | |
| 2008/0169369 | A1 | 7/2008 | Wang | |
| 2010/0243774 | A1 * | 9/2010 | Hu et al. | 241/30 |
| 2010/0243775 | A1 * | 9/2010 | Chen | 241/37.5 |
| 2011/0024535 | A1 * | 2/2011 | Chen | 241/37.5 |

FOREIGN PATENT DOCUMENTS

| | | |
|---|---|---|
| CN | 200910055706 | 7/2009 |
| WO | WO2009/058225 | 5/2009 |

* cited by examiner

*Primary Examiner* — Faye Francis
*Assistant Examiner* — Onekki Jolly
(74) *Attorney, Agent, or Firm* — WHGC, P.L.C.; John F. O'Rourke

(57) ABSTRACT

A safety inlet apparatus for a paper feed opening of a shredder, with cutting cylinders including an upper casing having a feed end with a safety dam with upper and lower indices. An angled plate means set apart from the upper casing forms the paper feed opening. A safety plate with a distal index end is provided, which is formed to traverse the feed opening from the angled plate to the safety dam. Also included is a pivot, and a power control switch. The pivot is configured to facilitate traversal of the safety plate distal index from the angled plate to the safety dam. The power limit switch is on the upper casing, apart from the pivot member. The traversal of the safety plate distal index end to the safety dam lower index causes the power control switch to stop comminution. A buckle bit plate provides open and closed detents.

19 Claims, 8 Drawing Sheets

SAFETY SHREDDER

BACKGROUND

1. Technical Field

The present invention relates to the technical field of a paper shredder, particularly to a protection apparatus for a paper shredder, and more particularly, to a paper shredder feed opening safety inlet apparatus.

2. Background Art

Paper shredders currently in the consumer and business markets have a narrow gap through which paper is fed to the shredder cutting apparatus. By design, the gap in a paper feed passage is limited in size, to protect a user or other party from inadvertently coming into contact with the shredder blade, or to protect the shredder blade apparatus by limiting the opening into which foreign matter may fall. When excessive paper is pushed into the feed opening (an "overfeed"), a thick cluster of paper may form in, and may block the paper feed passage. If comminution continues during an overfeed, the shredder motor and gears may be damaged. A shredder operator may be tempted to manually clear the overfeed while the motor is energized and become injured.

Also, as the cluster of paper in the paper feed passage moves deep into the passage, the usual gap in paper feed passage can be widened, allowing foreign matter to enter paper feed passage as comminution continues, further endangering a paper shredder operator and damaging the shredder. However, complex apparatus attempting to solve the problem tend to be unacceptably costly. There is a need for paper shredder feed opening safety apparatus, which can improve user safety at a lower cost.

SUMMARY OF THE INVENTION

Embodiments of the present invention provide a safety inlet apparatus for a paper feed opening of a shredder, which has cutting cylinders. An embodiment includes an upper casing of the shredder, the upper casing having a feed end with a safety dam. The safety dam includes a top portion and a bottom portion. The top portion includes an upper index and a lower index. Also included is an angled plate set apart from the upper casing, the set apart portion forming at least a portion of the paper feed opening. A safety plate is provided, which is formed to traverse the paper feed opening from the angled plate to the safety dam. The safety plate has a distal index end. The embodiment also includes a pivot member, and a power control switch. The pivot member is coupled between the safety plate and the upper casing. The pivot member is positioned at least partly proximally, relative to the distal index end. The pivot member is configured to facilitate cantilevered traversal of the safety plate distal index end from the angled plate to the safety dam. The power control switch is disposed on the upper casing and distally set apart from the pivot member. The cantilevered traversal of the safety plate distal index end from the angled plate to the top portion of the safety dam exposes the paper feed opening for shreddant feeding and initiates comminution by the shredder cutting cylinders. The cantilevered traversal of the safety plate distal index end to the lower index of the safety dam causes the power control switch to stop comminution by the shredder cutting cylinders.

In an alternate embodiment the angled plate and the safety plate distal index end extend to the top portion of the safety dam form feed guides for the paper feed opening. In another embodiment, the safety plate proximal end is pivotally coupled to the upper casing. Yet other embodiments include elastic means coupled between the safety plate proximal end and the upper casing, wherein the elastic means biases the safety plate upward to contact the angled plate and to close the paper feed opening. Yet other certain embodiments employ elastic means around a longitudinal means of the safety cover to urge the safety plate to the closed position. The embodiments can employ a buckle bit to temporarily hold the safety plate in the open position. Still other embodiments include an upper cover having the upper casing on one side and the angled plate on the other side, and being formed with an opening that sets apart the upper casing from the angled plate. In still other embodiments, the angle of the angled plate makes difficult shredder operator contact with the comminution blades. In yet additional embodiments the depth of the feed opening relative to the shredder cutting cylinders prevents shredder operator or foreign object contact with the comminution blades.

Certain embodiments provide a safety shredder having cutting cylinders, an electric motor coupled to the cutting cylinders, a power control unit coupled to the electric motor and controlling power delivered to the electric motor, a housing surrounding the cutting cylinders and the electric motor, an angled plate formed in the first side and having an apex, the second side formed on the second side and being disposed with an upper deck positioned lower than the apex, in which the upper deck is disposed with a dam having an upper index and a lower index, the dam being adjacent the feed opening throat. The embodiments also include a safety plate having an index on a distal end and pivoting means on a portion of the proximal end, and switching means proximal to the pivoting means, and configured to cause the power control unit to turn off power to the electrical motor when actuated. The housing has an opening with the first side set apart from the second side to provide a feed opening throat. Comminution occurs when power is delivered to the electric motor. The safety plate is positioned above the second side upper deck. When the safety plate distal index is in contact with the angled plate, the feed opening throat closes. When the safety plate distal index is positioned at the upper index of the dam the feed opening throat opens and causes the power control unit to provide power to the electrical motor. When the safety plate distal index is positioned at the lower index of the dam the switching means actuates, turning off the motor.

The embodiments herein also include a safety inlet apparatus for a paper feed opening of a shredder having cutting cylinders, having a safety plate positioned in a closed position, in an open position, or in a safety position. The apparatus includes an upper casing of the shredder, the upper casing having a feed end with a safety dam, wherein the safety dam includes a lower index, and an angled plate set apart from the upper casing to form the paper feed opening. In yet other embodiments, the apparatus includes an upper cover having the angled plate on a first side and the upper casing on a second side, and being formed with an opening that sets apart the angled plate from the upper casing. The apparatus also includes a safety plate formed to traverse the paper feed opening from the angled plate to the safety dam. The safety plate has a distal index end. A pivot member coupled between the safety plate and the upper casing, in which the pivot member is positioned longitudinally, relative to the safety plate, is configured to facilitate traversal of the safety plate distal index end from the angled plate to the safety dam. In addition, a power limit switch is disposed on the upper casing, set apart from the pivot member, and coupled to a power control unit.

The traversal of the safety plate distal index end from the angled plate to the safety dam exposes the paper feed opening for shreddant feeding and initiates comminution by the shredder cutting cylinders; and the traversal of the safety plate distal index end to the lower index of the safety dam actuates the power limit switch to stop comminution by the shredder cutting cylinders. In the closed position, the safety plate distal index end is adjacent to the apex. In the open position, the safety plate distal index end is disposed between the apex and the dam. In the safety position, the safety plate distal index end is adjacent to the lower index of the safety dam.

BRIEF DESCRIPTION OF THE DRAWINGS

Embodiments of the present invention disclosed herein are illustrated by way of example, and are not limited by, the accompanying figures, in which like references indicate similar elements, and in which.

Skilled artisans can appreciate that elements in the figures are illustrated for simplicity and clarity and have not necessarily been drawn to scale. For example, the dimensions of some of the elements in the figures may be exaggerated relative to other elements to help improve the understanding of the embodiments of the present invention.

DESCRIPTION OF THE EMBODIMENTS

Embodiments of the present invention can provide an inexpensive, reliable, and convenient solution to potential hazard and safety problems arising from forced entry of an object into the shredder paper feed throat inlet. In accordance with the following description, certain embodiments of a safety inlet apparatus for paper shredder can be realized, inter alia, using a traversing safety cover in the paper feed inlet or opening. In other embodiments, a safety plate is oriented to a longitudinal axis and rotates about that axis, to provide the functionality of the safety shredder.

In general, during normal operation, the safety plate can be opened to create an acceptable gap, and allowing comminution to occur. When excessive paper or foreign matter is introduced into paper feed passage, the safety plate tends to be forced open, which actuates a power limit switch, thereby depowering the shredder motor. An elastic member, such as a tension spring, can provide a force to close the safety plate, when the shredder is not in use.

Figure 1:
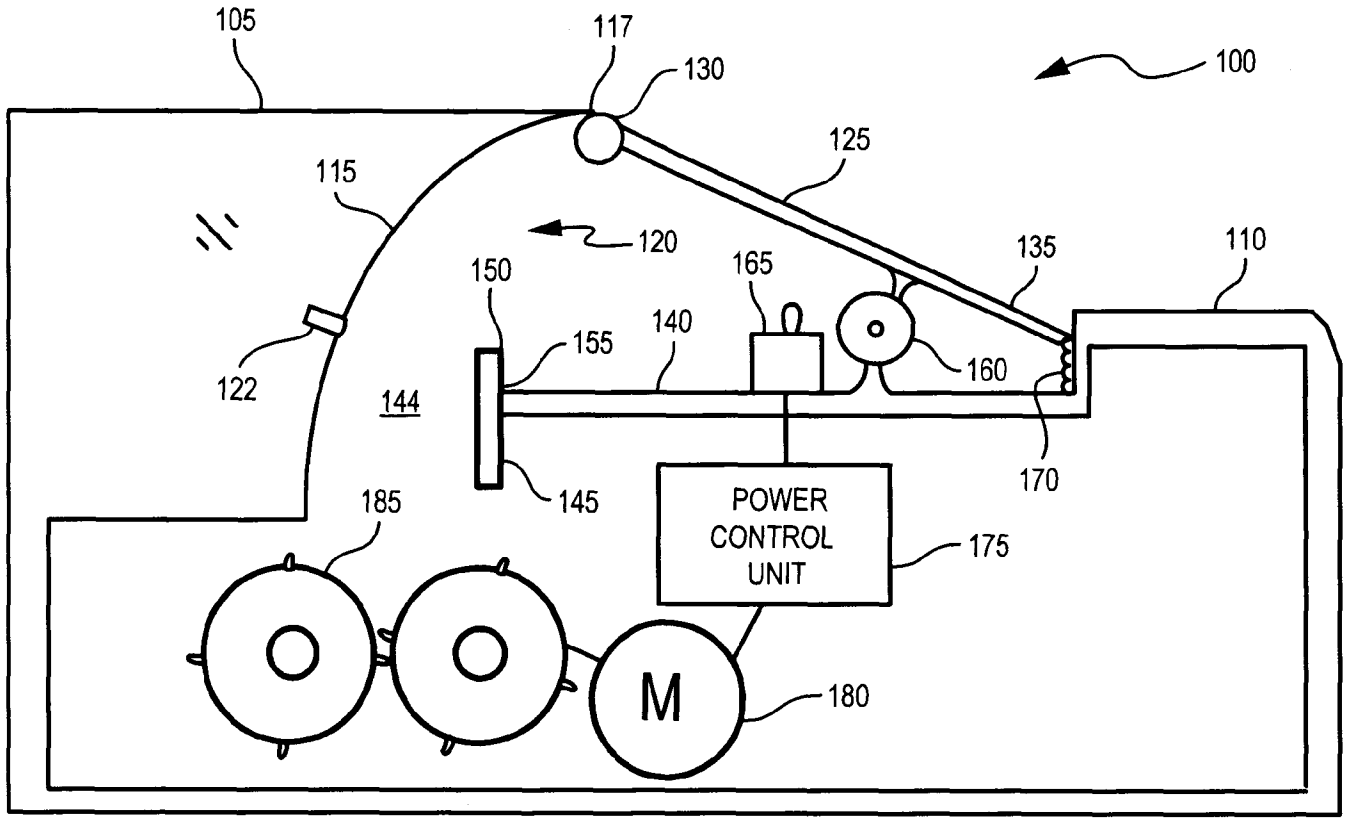
FIG. 1 is a side cross-sectional view of one embodiment of a paper shredder having a safety plate closing the paper feed opening, in accordance with the present invention.
Figure 2:
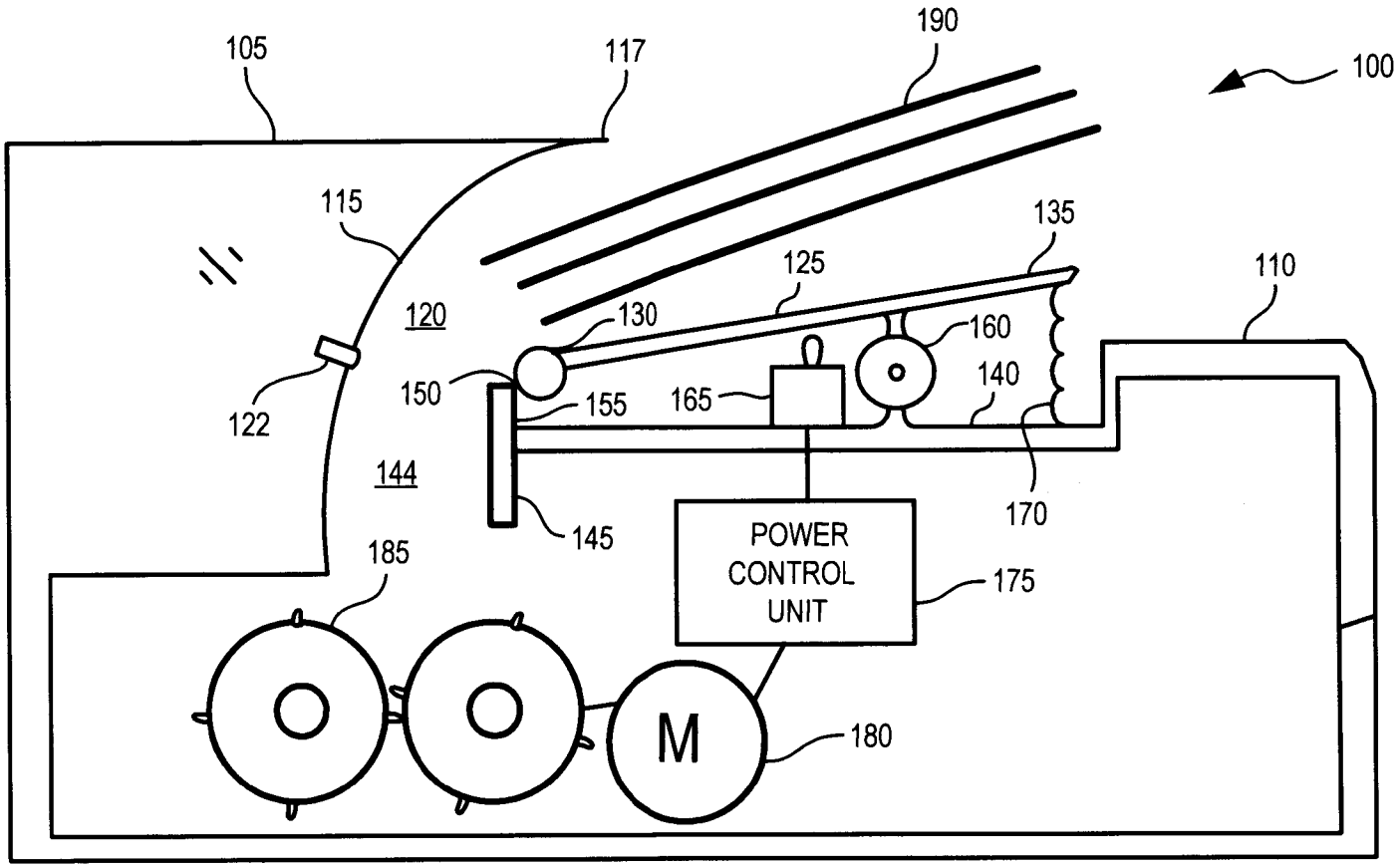
FIG. 2 is a view of paper shredder embodiment as shown in FIG. 1, in which the paper feed opening is open to receive shreddant, in accordance with the present invention.
Figure 3:
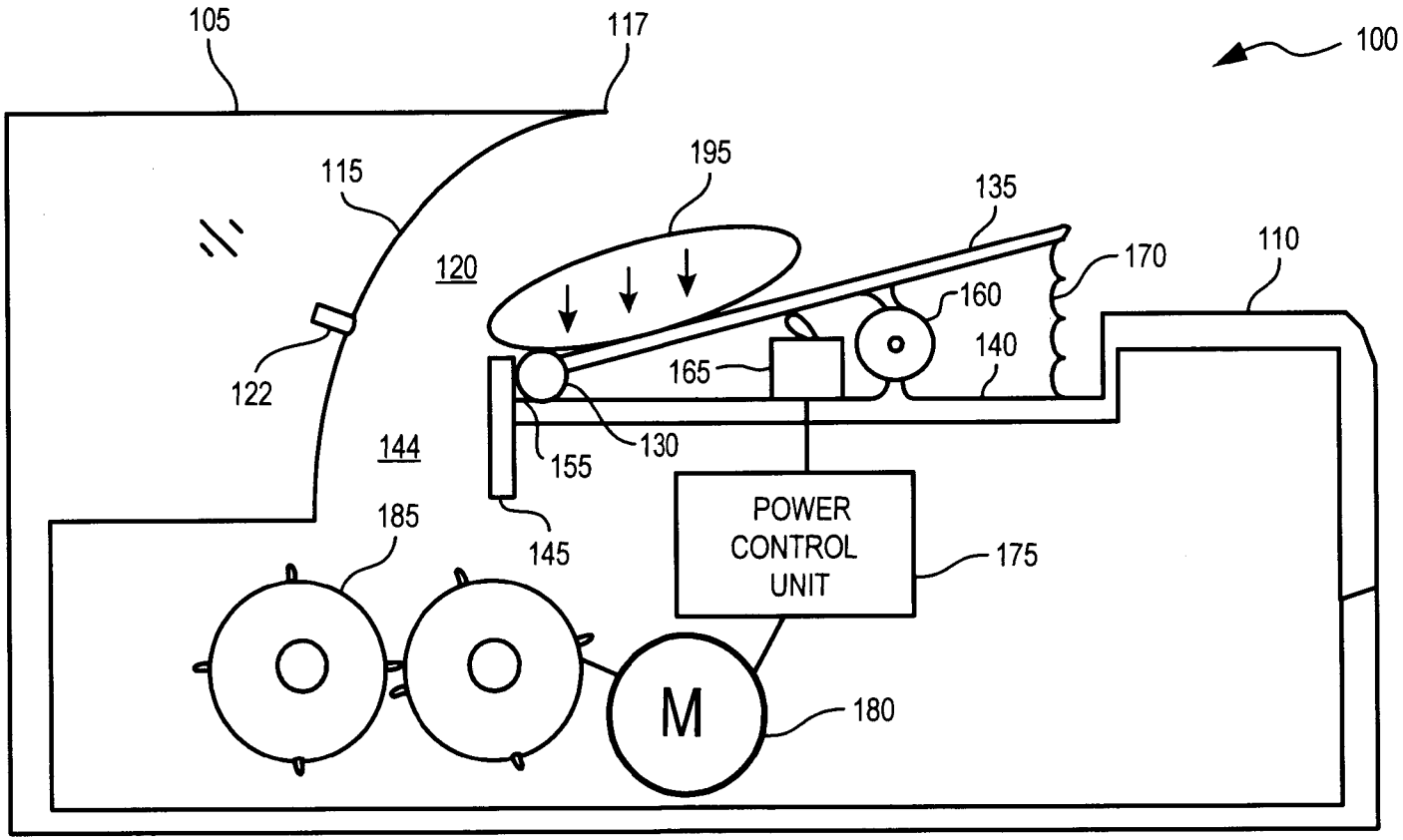
FIG. 3 is a view of the shredder embodiment in normal operation as shown in the embodiment of FIG. 1 and FIG. 2, in which the safety plate is in the safety position, in accordance with the teachings of the present invention.

Referring to FIGS. 1-3, example embodiments of safety shredder 100 may include an upper housing 105 and an upper casing 110 set apart from housing 105 to form a paper feed opening 120. Housing 105 and casing 110 are shown as a single unit although they are not so constrained. Housing 105 includes angled plate 115, which also forms a portion of paper feed opening 120. Angled plate 115 includes apex 117. Safety plate 125 includes proximal portion 135 and distal index 130. A portion of upper casing 110 is upper deck 140. Extending from a distal end of upper deck 140 can be dam 140. Dam 140 can consist of an upper index 150 and a lower index 155. Disposed on upper deck 140 can be pivoting member 160. In general, pivoting member 160 pivotally supports safety plate 125 and disposes safety plate 125 to arcuately traverse from angled plate apex 117 to dam 145, thereby closing or exposing paper feed opening 120. A detent (not shown) can be included within pivoting member 160 to keep paper feed opening 120 open during a shredding operation. Shreddant 190 placed into paper feed opening 120 is detected by sensor 122, causing power control unit 175 to energize electric motor 180. Sensor 122 can be, without limitation, a mechanical, an electrical, or an optical sensor coupled to power control unit 175. Shreddant 190 can pass through the feed throat 144 and can be comminuted by cutting cylinders 185, which can be motivated by electric motor 180. Power to electric motor 180 can be controlled by power control unit 175, which causes electrical power to be supplied to, or removed from, motor 180. When power is provided to motor 180, cutting cylinders 185 rotate to comminute shreddant 190. Also attached to upper deck 140 can be power limit switch 165. Power limit switch 165 can be coupled to power control unit 175. When actuated, power limit switch 165 can cause power control unit 175 to stop motor 180, also stopping comminution. In its normal position, power limit switch 165 allows power to be supplied to motor 180. In addition, elastic member 170 provides a counterforce disposed to keep closed safety plate 125 or to urge plate 125 to close while opened. In some embodiments, the angle of angled plate 115 can be positioned to make difficult operator contact with the cutting cylinders. In additional embodiments, the depth of the feed opening relative to cutting cylinders 185 can be sufficient to prevent shredder operator contact or foreign objects from coming into unforced contact with operating cutting cylinders.

In FIG. 1, safety plate 125 is in the closed position. Safety plate distal index 130 can be held adjacent to apex 117 of angled plate 115. Paper feed opening 120 can be closed and may be tightly closed, relative to the tensioning force of elastic member 170.

In FIG. 2, safety plate 125 can be swung down, exposing paper feed opening 120, and allowing shreddant 190 to be fed into cutting blades 185. Power control unit 175 activates motor 180 in the open position, when shreddant 190 is detected by sensor 122, and comminution proceeds. Under normal feeding conditions, safety plate distal index 130 can be held adjacent to dam upper index 150 by the detent in pivoting member 160. Paper feed opening 120 may be between 3 mm and 10 mm in the open position and, typically, 5-7 mm. In general, this distance corresponds to the distance between a wall of throat 144 and dam 145. Power limit switch 165 may not be actuated when safety plate 125 is in this position, even with feed opening 120 being exposed.

In FIG. 3, foreign object 195 imposes additional force upon safety plate 125, causing safety plate distal index 130 to be deflected toward dam lower index 155. This positioning of safety plate 125 can engage and actuate power limit switch 165, causing power control unit 175 to remove power from motor 180, ceasing comminution. Foreign object 195 may be a hand of a shredder operator.

Figure 4:
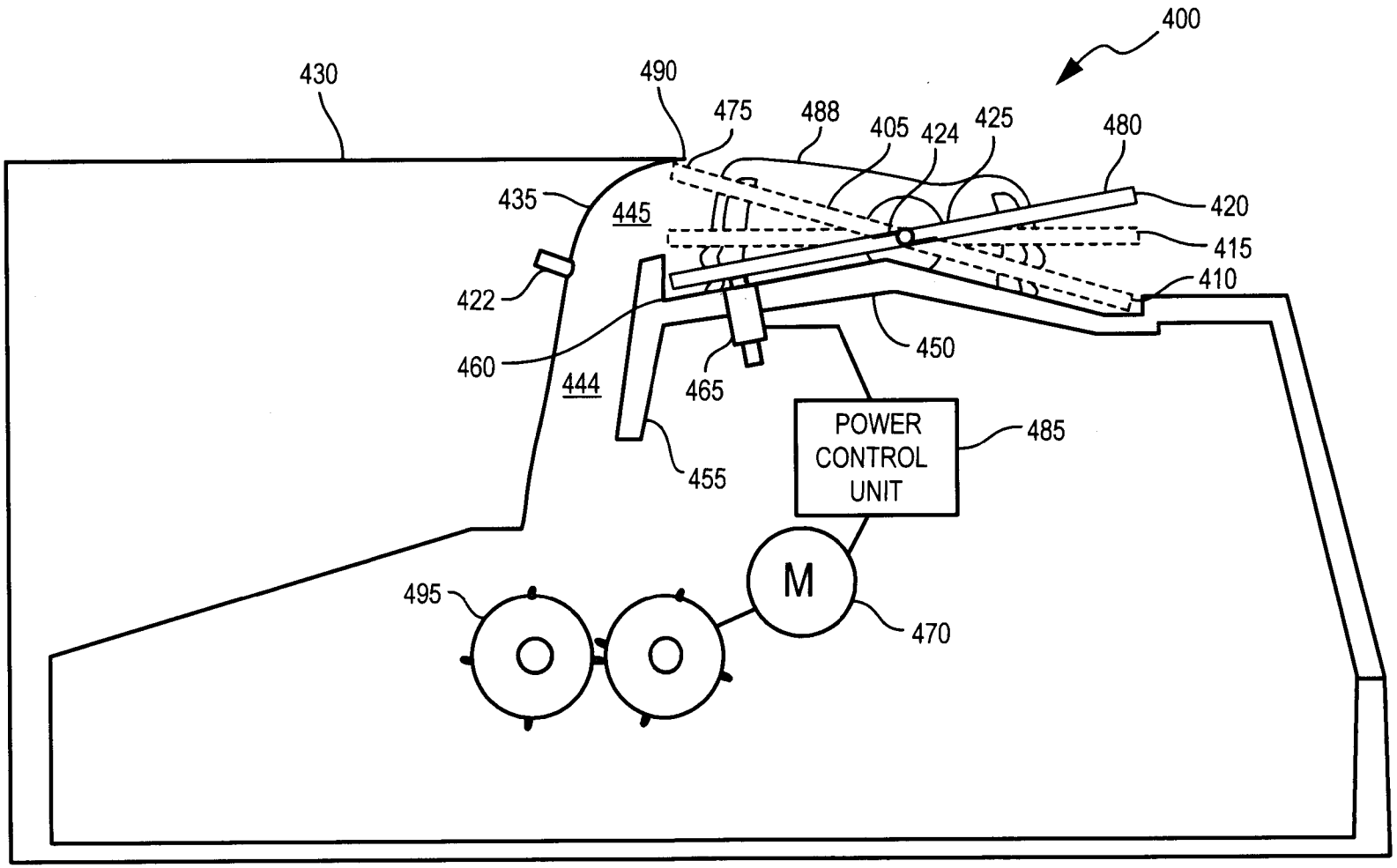
FIG. 4 is a side cross-sectional view of another embodiment of a paper shredder having a longitudinal safety plate compositely positioned in the paper feed opening, in accordance with the present invention.

FIGS. 4-8 illustrate yet another embodiment of a safety shredder 400, in accordance with the present invention. Shredder 400 may be similar to shredder 100. FIG. 4 illustrates a composite illustration of a paper shredder of the current embodiments, in which safety plate 405 is positioned in the safety plate closed position 410, in the safety plate open position 415, and in the safety plate safety position 420. In the current configuration, safety plate 405 is disposed around longitudinal pivot means 425. In such embodiments, safety plate 405 can be balanced on a longitudinal pivot means 425. Therefore, safety plate 405 can be placed in one of three positions relative to paper feed opening 445: closed 410, open 415, and safety 420. Elastic member 424 can be used optionally to bias safety plate 405 to the closed position. Buckle bit 488 may be used to temporarily hold safety plate 405, for example, in the open or closed position. In general, the open position 415 is a position between the closed position 410 and the safety position 420.

Safety shredder can have an upper housing 430 having angled plate 435 set apart from an upper casing 440. Angled plate 435 can have an apex 490. The set apart portion between apex 490 and vertical safety dam 455 can form at least a portion of the paper feed opening throat 444 of paper feed opening 445. Sensor 422 can be coupled to power control unit 485. Sensor 422 can be positioned in throat 444, such that shreddant 466 entering paper feed opening 445 can be detected by sensor 422, causing power control unit 485 to energize electric motor 470. Sensor 422 can be, without limitation, a mechanical, an electrical, or an optical sensor. Upper casing 440 includes an inclined upper deck 450 coupled to an approximately vertical safety dam 455. The safety dam 455 includes a lower index 460. In addition, power limit switch 465 can be disposed in upper deck 450 and inclined such that, when safety plate 405 is in the safety position, the safety plate 405 actuates the power limit switch 465, which causes power control unit 485 to cut off power to the shredder motor 470. Such a cut-off can occur with material being in feed throat 444. The safety plate 405 can pivot on a pivot means 410 disposed on a longitudinal axis relative to the safety plate 405. The safety plate 405 is configured to traverse the generally vertical plane of the paper feed opening 445 from the angled plate 435 to the safety dam 455. The safety plate 405 has a distal index end 475 and proximal end 480. Longitudinal pivot means 425 can be biased by a tension spring 424 that relaxes in the closed position 410. Also, in some embodiments, disposed on one or both ends of longitudinal pivot means can be disposed detent device 488, which may be in the form of, without limitation, a buckle bit plate. The buckle bit plate 488 can have two recesses or detents that accommodate corresponding protrusions 487*a*-*b* disposed on either end of safety plate 405, as is described relative to FIG. 8.

Figure 8:
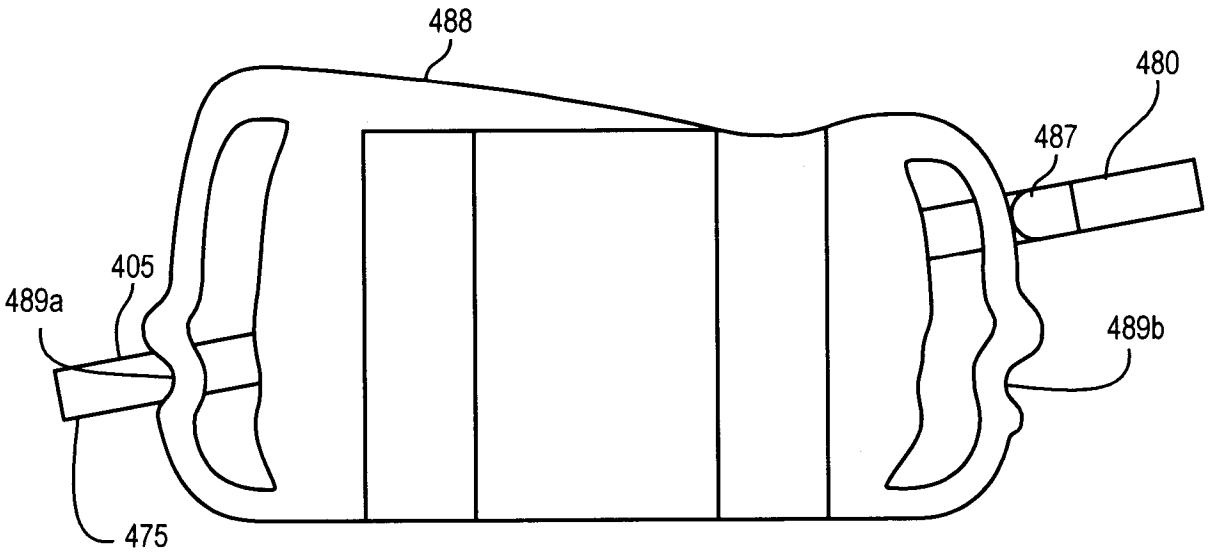
FIG. 8 is a side view of a buckle bit plate interactive with the safety plate, in accordance with the present invention.

FIG. 8 illustrates buckle bit 488 holding safety plate 405 in the open position. Safety plate 405 can have protrusions 487*a*, 487*b* which may mate with buckle bit detents 489*a*, 489*b*, respectively. From this perspective, protrusion 487*a* is not seen due to its mating position with buckle bit detent 489*a*. When safety plate 405 distal end 475 protrusion 487*a* (not seen due to mating) is mated to buckle bit detent 489*a*, safety plate 405 is in the open 415 position. When safety plate 405 proximal end 480 protrusion 487*b* is mated to buckle bit detent 489*b*, safety plate 405 is in the closed 410 position. When safety plate 405 is pressed downward extendingly, distal end 475 protrusion 487*a* comes out of buckle bit detent 489*a*, and distal end 475 actuates power limit switch 465 (not shown), causing shutdown of the shredder.

Figure 5:
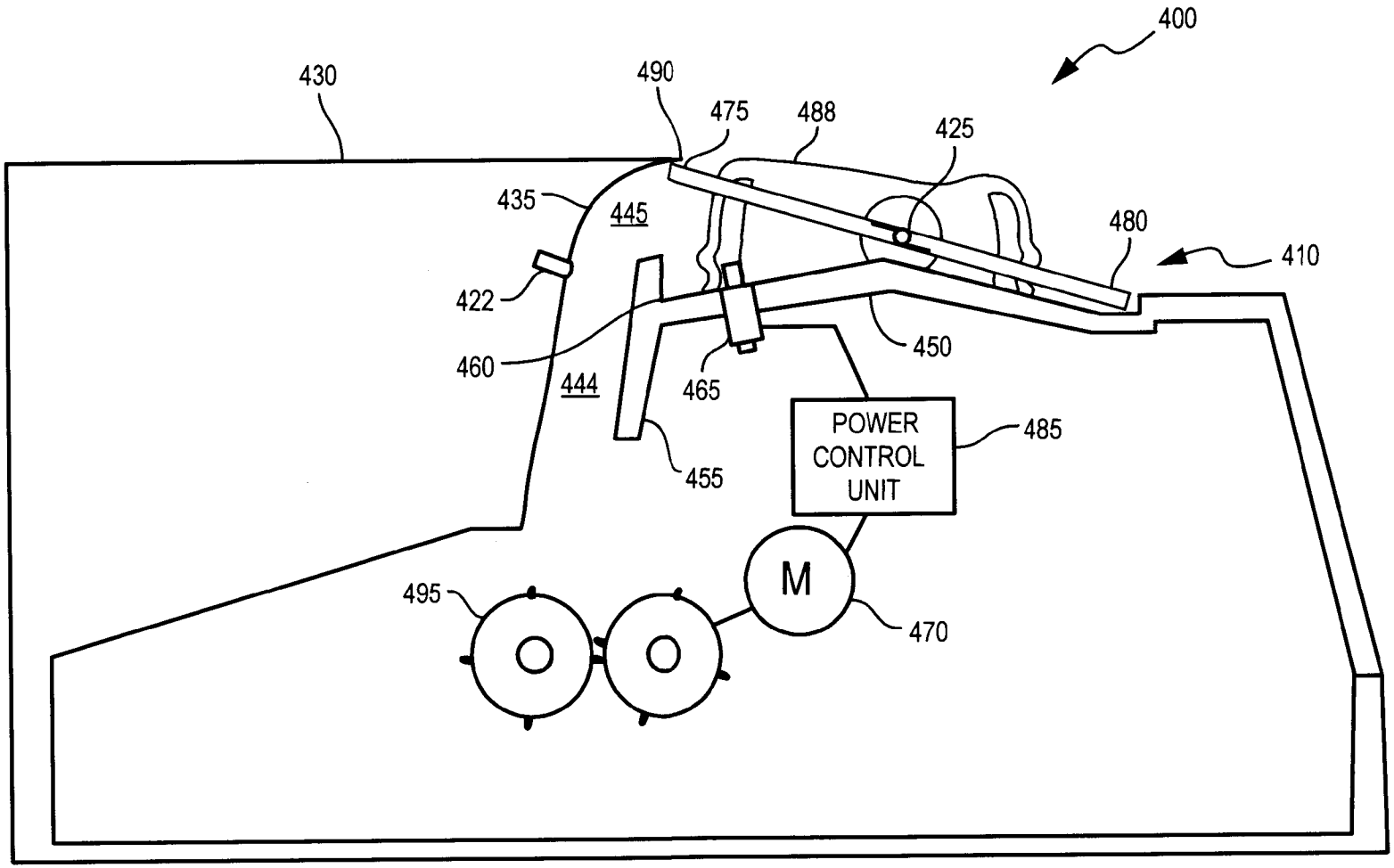
FIG. 5 is a view of the paper shredder embodiment of FIG. 4, with the longitudinal safety plate be disposed in a closed position, in accordance with the present invention.

As depicted in FIG. 5, when in the closed position 410, the proximal portion 480 of safety plate 405 is depressed, causing distal portion 475 to contact the apex 490 of the angled plate 435, thereby closing the paper feed opening 445. In the closed position, safety plate 405 can be held closed by proximal end 480 protrusion 487*a* in safety plate 405 mating with closed detent 489*a* in buckle bit plate 488.

Figure 6:
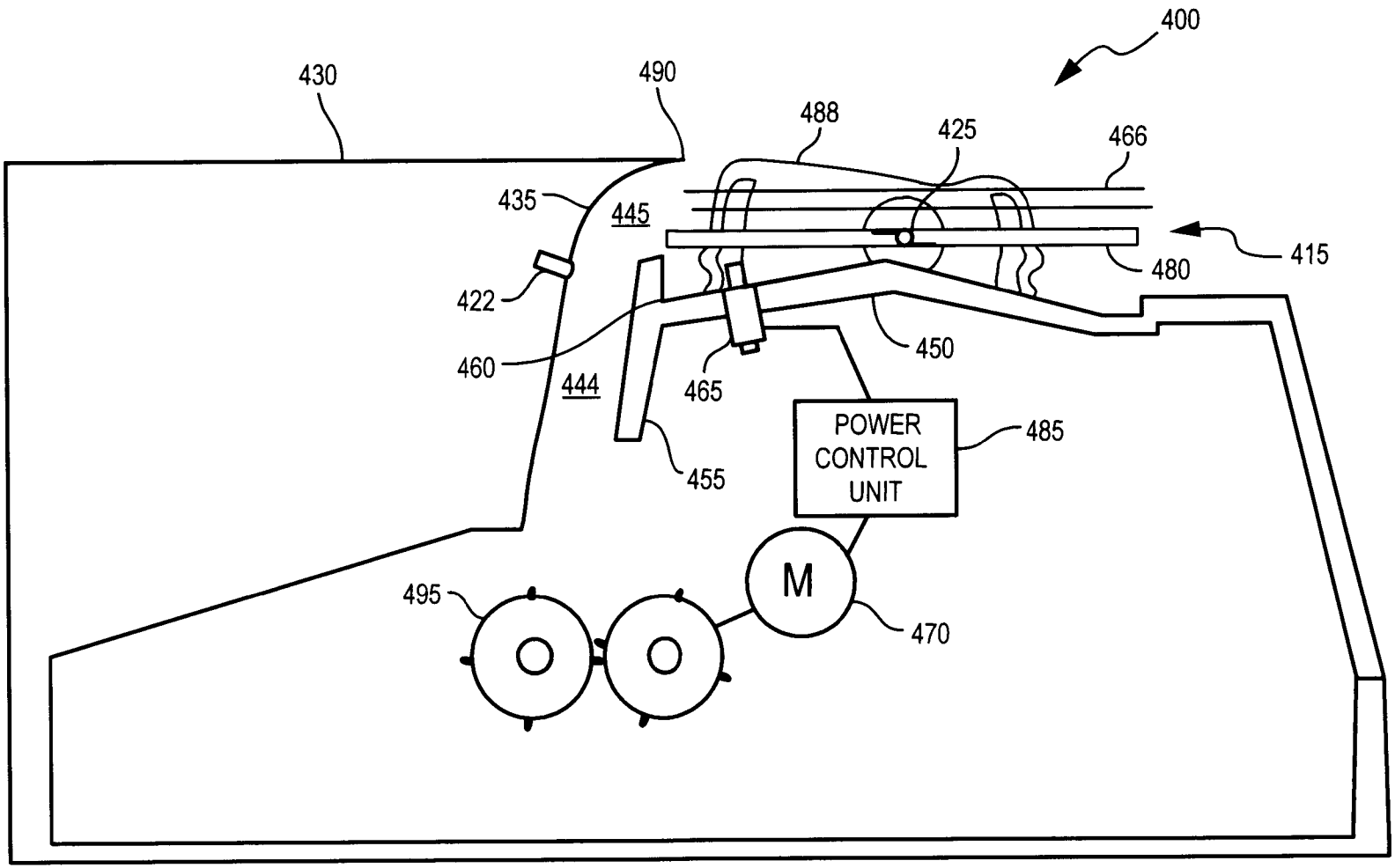
FIG. 6 is a view of the paper shredder embodiment of FIG. 4, with the longitudinal safety plate be disposed in an open position, in accordance with the present invention.

In FIG. 6, the safety plate 405 is moved to the open position 415 by slightly deflecting downward safety plate 405 distal index end 475. In the open position 415, safety plate 405 can be held open by open detent 492. This action tends to open paper feed opening 445, allowing shreddant 466 to pass into the paper feed throat 444. Sensor 422 then can detect the presence of shreddant 466, and can send an activation signal to power control unit 485. Power control unit 485 can cause power to be applied to shredder motor 470, allowing cutting cylinders 495 to comminute the shreddant 466. Paper feed opening 445 may be between 3 mm and 10 mm in the open position, and typically 5-7 mm, depending upon the position of the angled plate apex 490 relative to the open position of safety plate 405. When in the open position 410, power control unit 485 activates electrical motor 470 to cause comminution.

Figure 7:
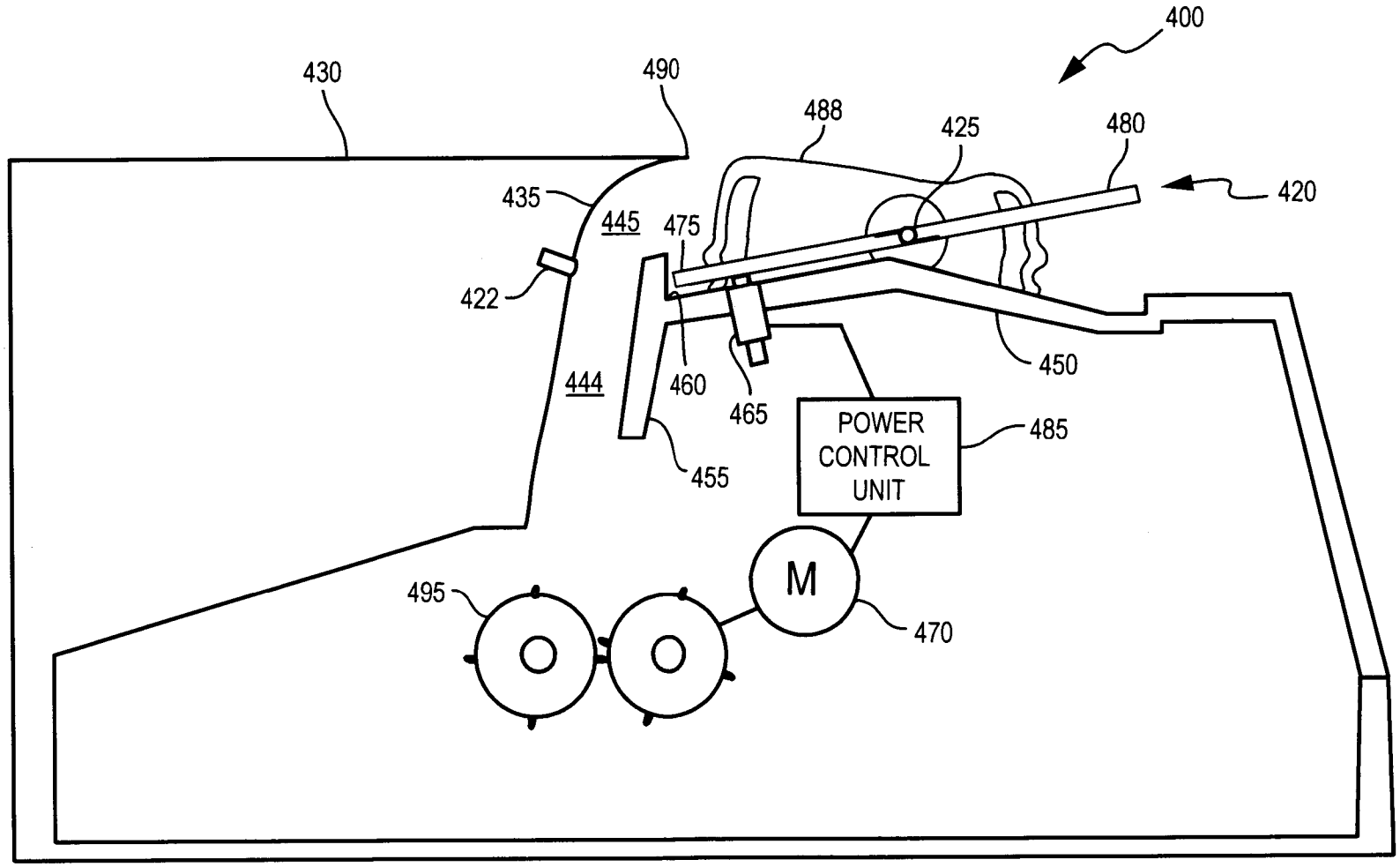
FIG. 7 is a view of the paper shredder embodiment of FIG. 4, with the longitudinal safety plate be disposed in a safety position, in accordance with the present invention.

FIG. 7 depicts safety plate 405 in the safety position 420. Similar to FIG. 3, safety plate 405 can be deflected beyond the open position 415, for example, by a shredder operator placing a hand in the feed throat 444, or by attempting to force a foreign object into paper feed opening throat 444. When the safety plate 405 pivots so that the distal index end 475 is adjacent the lower index 460 of the dam, the safety plate 405 impinges upon an actuator of the power limit switch 465, which actuates the power control unit 485 to turn off the electric motor 470 and to cease comminution.

Although the present invention has been described in terms of example embodiments, it is to be understood that neither the Specification nor the Drawings are to be interpreted as limiting. Other embodiments and configurations have been taught by the foregoing embodiments, and modifications and substitutions thereof are comprehended by this description. Various alternations and modifications are inherent, or will become apparent to those skilled in the art after reading the foregoing disclosure. Accordingly, it is intended that the appended claims be interpreted as covering all alternations and modifications that are encompassed by the spirit and the scope of the invention.

What is claimed is:

1. A safety inlet apparatus for a paper feed opening of a shredder having cutting cylinders with comminution blades thereon, comprising:

an upper deck of the shredder, the upper deck having a feed end with a safety dam, wherein the safety dam includes a top portion and a bottom portion;

an angled plate set apart from the upper deck forming at least a portion of the paper feed opening;

a safety plate formed to traverse the paper feed opening from the angled plate to the safety dam, the safety plate having a distal index end;

a pivot member coupled between the safety plate and the upper casing, wherein the pivot member is positioned at least partly proximally to the upper casing, and is configured to facilitate cantilevered traversal of the safety plate distal index end from the angled plate to the safety dam; and a power limit switch disposed on the upper casing and distally set apart from the pivot member, the power limit switch preventing comminution when activated;

wherein the cantilevered traversal of the safety plate distal index end from the angled plate to a top portion of the safety dam exposes the paper feed opening for shreddant feeding and allows comminution by the shredder cutting cylinders; and wherein the cantilevered traversal of the safety plate distal index end to a bottom portion of the safety dam activates the power limit switch causing the power limit switch to stop comminution by the shredder cutting cylinders.

2. The safety inlet apparatus of claim 1, wherein the angled plate and the safety plate distal index end extended to the top portion of the safety dam form feed guides for the paper feed opening.

3. The safety inlet apparatus of claim 1, wherein a safety plate proximal end is pivotally coupled to the upper casing.

4. The safety inlet apparatus of claim 1, further comprising: an elastic element coupled between the safety plate proximal end and the upper casing, wherein the elastic element biases the safety plate upward to contact the angled plate and to close the paper feed opening.

5. The safety inlet apparatus of claim 1, further comprising an upper housing having the angled plate on a first side and an upper deck on a second side, and being formed with an opening that sets apart the angled plate from the upper deck.

6. The safety inlet apparatus of claim 1, wherein the extrema of a cantilevered traversal arc are the apex of the angled plate and the lower index of the safety dam.

7. The safety inlet apparatus of claim 4, wherein an angle of the angled plate makes difficult shredder operator contact with the comminution blades.

8. The safety inlet apparatus of claim 4, wherein a depth of the feed opening relative to the shredder cutting cylinders prevents shredder operator contact with the comminution blades.

9. The safety inlet apparatus of claim 4, wherein a depth of the feed opening relative to the shredder cutting cylinders prevents foreign object contact with the comminution blades.

10. A safety shredder, comprising:

cutting cylinders;

an electric motor mechanically coupled to the cutting cylinders, wherein comminution by the cutting cylinders occurs when power is delivered to the electric motor;

a power control unit electrically coupled to the electric motor and controlling power delivered to the electric motor;

a housing surrounding the cutting cylinders and the electric motor, wherein the housing has an opening with a first side set apart from a second side to provide a feed opening throat;

an angled plate formed in the first side and having an apex; the second side formed with an upper deck positioned lower than the apex;

the upper deck being disposed with a dam having an upper index and a lower index, the dam being adjacent the feed opening throat;

a safety plate having an index on a distal end and a pivot on a portion of the proximal end, wherein the safety plate is positioned above the second side upper deck; and a switch proximal to the pivot, and configured to cause the power control unit to turn off power to the electrical motor when actuated, wherein when the safety plate distal index is in contact with the angled plate, the feed opening throat is closed;

wherein when the safety plate distal index is positioned between the apex and the dam, the feed opening throat is open and the power control unit is caused to provide power to the electrical motor, and wherein when the safety plate distal index is positioned at the lower index of the dam, the switch actuates, turning off the motor.

11. A safety inlet apparatus for a paper feed opening of a shredder having cutting cylinders, comprising:

an upper deck of the shredder, the upper deck having a feed end with a safety dam, wherein the safety dam includes a lower index;

an angled plate set apart from the upper deck to form the paper feed opening;

a safety plate formed to traverse the paper feed opening from the angled plate to the safety dam, the safety plate having a distal index end;

a pivot coupled to the safety plate and the upper deck, wherein the pivot is positioned longitudinally relative to the safety plate, and is configured to facilitate traversal of the safety plate distal index end from the angled plate to the safety dam; and a power limit switch disposed on the upper deck and set apart from the pivot and coupled to a power control unit;

wherein traversal of the safety plate distal index end from the angled plate to a top portion of the safety dam exposes the paper feed opening for shreddant feeding and allows comminution by the shredder cutting cylinders; and wherein the traversal of the safety plate distal index end to a bottom portion of the safety dam actuates the power limit switch to stop comminution by the shredder cutting cylinders.

12. The safety inlet apparatus of claim 11, further comprising an upper housing having the angled plate on a first side and the upper deck on a second side, and being formed with an opening that sets apart the angled plate from the upper deck.

13. The safety inlet apparatus of claim 11, wherein the safety plate is positioned in a closed position, in an open position, or in a safety position.

14. The safety inlet apparatus of claim 11, wherein the pivot is integrated with the safety plate.

15. The safety inlet apparatus of claim 11, further comprising on the safety plate and a buckle bit plate with two detents, wherein one protrusion is detained by a first detent, corresponding with the closed position and another protrusion is detained by a second detent, corresponding with the open position.

16. The safety inlet apparatus of claim 11, further comprising a buckle bit with open and closed position detents, coupled to the safety plate having proximal and distal protrusions matable with the open and closed position detents, wherein the buckle bit is used to bias the safety plate in one of the open position or the closed position.

17. The safety inlet apparatus of claim 13, wherein in the closed position the safety plate distal index end is adjacent to the apex.

18. The safety inlet apparatus of claim 13, wherein in the open position the safety plate distal index end is disposed between the apex and the dam.

19. The safety inlet apparatus of claim 13, wherein in the safety position the safety plate distal index end is adjacent to the lower index of the safety dam.

* * * * *